US006090770A

United States Patent [19]

Mendoza et al.

[11] Patent Number: 6,090,770

[45] **Date of Patent: *Jul. 18, 2000**

[54] AQUEOUS BLEACHING AGENTS

[75] Inventors: Mercedes Mendoza, Barcelona; Jaume Josa, Terrassa, both of Spain

[73] Assignee: Henkel Kommanditgesellschaft auf Aktien, Duesseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/341,541

[22] PCT Filed: Dec. 19, 1997

[86] PCT No.: PCT/EP97/07166

§ 371 Date: Jul. 13, 1999

§ 102(e) Date: Jul. 13, 1999

[87] PCT Pub. No.: WO98/30671

PCT Pub. Date: Jul. 16, 1998

[30] Foreign Application Priority Data

Jan. 13, 1997 [DE] Germany ..... 197 00 799

[51] Int. Cl.[7] ..... C11D 3/395; C11D 3/60; C11D 17/00

[52] U.S. Cl. ..... 510/380; 510/434; 510/435; 510/436

[58] Field of Search ..... 510/380, 379, 510/405, 434, 435, 436

[56] References Cited

U.S. PATENT DOCUMENTS

| | | | |
|---|---|---|---|
| 4,690,771 | 9/1987 | Ouhadi et al. | 252/102 |
| 4,744,916 | 5/1988 | Adams et al. | 252/99 |
| 5,252,242 | 10/1993 | Shevade et al. | 252/97 |
| 5,296,239 | 3/1994 | Colery et al. | 424/613 |
| 5,449,477 | 9/1995 | Eckhardt | 252/186.1 |
| 5,688,756 | 11/1997 | Garabedian et al. | 510/369 |
| 5,703,245 | 12/1997 | Cavalotti et al. | 548/473 |
| 5,716,924 | 2/1998 | Balaguer et al. | 510/336 |
| 5,804,545 | 9/1998 | Hemling et al. | 510/373 |
| 5,916,859 | 6/1999 | Choy et al. | 510/195 |

FOREIGN PATENT DOCUMENTS

| | | |
|---|---|---|
| 0421738 | 4/1991 | European Pat. Off. . |
| 0622451 | 11/1994 | European Pat. Off. . |
| 0743391 | 11/1996 | European Pat. Off. . |
| WO 94/10272 | 5/1994 | WIPO . |

*Primary Examiner*—Yogendra Gupta
*Attorney, Agent, or Firm*—Wayne C. Jaeschke; Glenn E. J. Murphy

[57] ABSTRACT

The invention concerns novel aqueous bleaching agents containing—relative to the agents—between 1.0 and 10.0 wt % alkali hypochlorite, between 0.5 and 1.5 wt % alkali hydroxide, between 0.5 and 2.0 wt % silicates, between 0.01 and 1.0 wt % phosphonic acids and/or phosphonates, and between 0.01 and 1.0 wt % polyacrylic acid compounds as well as optionally other conventional additives and auxiliary materials. The agents can be formulated without turbidity and reliably protect the textiles treated therewith against encrustation and yellowing, even in the presence of water hardness and heavy metal ions.

20 Claims, No Drawings

AQUEOUS BLEACHING AGENTS

BACKGROUND OF THE INVENTION

1. Field of the Invention

This invention relates to new aqueous bleaching compositions containing alkali metal hypochlorites, alkali metal hydroxides and a ternary inhibitor system and to the use of the ternary mixture as an incrustation and yellowing inhibitor for the production of aqueous bleaching compositions.

2. Discussion of Relative Art

Whereas powder-form or liquid heavy-duty detergents which only develop their cleaning performance at relatively high temperatures are used in many European countries for washing heavily soiled textiles, consumers in the USA and Spain, for example, preferred cold washing where a liquid bleach, preferably based on hypochlorite, is added in addition to a detergent in order to remove particularly difficult stains.

Numerous liquid bleaching compositions are known from the prior art. Thus, EP-A 0 274 885 (ICI), for example, recommends the use of mixtures of linear and branched amine oxides for the production of viscous hypochlorite bleaches. According to the teaching of EP-A 0 145 084 (Unilever), mixtures of amine oxides with soaps, sarcosinates, taurides or sugar esters may also be used for this purpose. The use of amine oxides with soap or sarcosinate and other anionic surfactants, for example alkyl sulfates, alkyl ether sulfates, secondary alkane sulfonates or alkyl benzenesulfonates, as thickening component for hypochlorite solutions is known from EP-A 0 137 551 and EP-A 0 447 261 (Unilever). EP-A 0 156 438 reports on the use of alkylaryl sulfonates as thickeners in aqueous bleaching compositions which contain certain stilbene dyes as optical brighteners. ES-A 8801389 (Henkel Ibérica) relates to bleaching compositions based on aqueous hypochlorite solutions which predominantly contain alkyl ether sulfates and, in addition, small amounts of amine oxides as surfactant component. In addition, aqueous bleaching compositions containing sodium hypochlorite and anionic surfactants are known from EP-A1 0 447 261. However, the hypochlorite concentration of these compositions is between 0.1 and 8% by weight and preferably between 0.5 and 5% by weight of active chlorine. In German patent DE-C1 4 333 100, applicants propose aqueous bleaching and cleaning compositions based on hypochlorites, fatty alcohol ether sulfates, amine oxides and amine oxide phosphonic acids.

International patent applications WO 94/10272, WO 95/03383, WO 95/08610 and WO 95/08611 (Procter & Gamble) relate to hypochlorite-containing bleaching compositions containing short-chain anionic surfactants such as, for example, octyl sulfate. European patent application EP-A 0 688 857 (Procter & Gamble) describes hypochlorite-containing bleaching compositions containing periodates and carbonates for adjusting the pH value. European patent application EP-A 0 688 345 (Procter & Gamble) relates to hypochlorite-based bleaching compositions containing small quantities of silicates and/or carbonates, polycarboxylates and radical scavengers. An alkaline hypochlorite-based bleaching composition containing carbonates and silicates for stabilizing perfume oils is also proposed in European patent application EP-A 0 622 451 (Procter & Gamble).

Bleaching compositions of the type mentioned above are expected to satisfy stringent consumer requirements. They have to be laundry-compatible, i.e. the treatment with the basically aggressive chemical hypochlorite is expected to remove stains without affecting the fabric. Since skin contact with the bleaching compositions cannot be ruled out, the compositions are also expected to be as dermatologically safe as possible. In cases where hard water is used for the washing process, there is the problem of lime deposits on the fibers and hence the danger of fabric incrustation, especially in the event of prolonged exposure to the composition. Another problem is that hypochlorite solutions also attack metals and the traces of metals dissolved in this way can be deposited on the textile fibers during the washing process which is ultimately reflected in yellowing of the fabric.

Accordingly, the complex problem addressed by the present invention was to provide storage-stable, non-clouding aqueous bleaching compositions which, at one and the same time, would be chlorine-stable, laundry-compatible and dermatologically safe, would have a sufficiently high viscosity and, for a high stain removing power, would reliably prevent the deposition of lime and metal traces on the fabrics.

DESCRIPTION OF THE INVENTION

The present invention relates to aqueous bleaching compositions containing—based on the composition—

1.0 to 10.0% by weight of alkali metal hypochlorite 0.5 to 1.5% by weight of alkali metal hydroxide 0.5 to 2.0% by weight of silicates 0.01 to 1.0% by weight of phosphonic acids and/or phosphonates and 0.01 to 1.0% by weight of polyacrylic acid compounds and optionally other typical auxiliaries and additives.

It has surprisingly been found that the addition of an inhibitor mixture consisting of defined quantities of silicates, phosphonic acids or phosphonates and polyacrylates to the alkaline hypochlorite solutions both significantly reduces the deposition of lime and metals on the fabrics during washing and hence counteracts incrustation and yellowing of the fibers and also enables non-clouding and storage-stable compositions to be formulated. The protection which the new compositions afford against incrustation and corrosion is clearly apparent above all in the event of long exposure times. The invention includes the observation that the additional use of mild chlorine-stable surfactants, such as—preferably—alkyl ether sulfates, amine oxides, alkyl and/or alkenyl oligoglycosides and fatty acid salts, leads to a further improvement in cleaning performance and dermatological compatibility. Finally, the compositions according to the invention have a sufficiently high viscosity so that they can readily be dosed by the consumer.

Alkali Metal Hypochlorites and Alkali Metal Hydroxides

Alkali metal hypochlorites in the context of the invention are understood to be lithium, potassium and—in particular—sodium hypochlorite. The hypochlorites may be used in quantities of preferably 3.0 to 7.0% by weight and, more preferably, 4 to 6% by weight, based on the composition. Alkali metal hydroxides are understood to be sodium and/or potassium hydroxide which are used in quantities of preferably 0.7 to 1.2% by weight, based on the composition.

Silicates

Silicates which may be used for the purposes of the invention are understood to include salts and esters of orthosilicic acid $Si(OH)_4$ and self-condensation products thereof. Accordingly, the following crystalline materials, for example, may be used as silicates:

(a) neosilicates (island silicates) such as, for example, phenakite, olivine and zirconium;

(b) sorosilicates (group silicates) such as, for example, thortveitite and hemimorphite;

(c) cyclosilicates (ring silicates) such as, for example, benitoite, axinite, beryllium, milarite, osumilite or eudialyte;

(d) inosilicates (chain and band silicates) such as, for example metasilicates (for example diopside) or amphiboles (for example tremolite);

(e) phyllosilicates (laminar and layer silicates) such as, for example, talcum, kaolinite or mica (for example muscovite);

(f) tectosilicates (skeletal silicates) such as, for example feldspars and zeolites and also clathrasils or dodecasils (for example melanophlogite), thaumasite and neptunite.

In contrast to the ordered crystalline silicates, silicate glasses, for example soda or potash waterglass, are preferably used. They may be of natural origin (for example montmorillonite) or may be synthesized. Another embodiment of the invention is characterized by the use of alumosilicates. Typical examples of alkali metal or alkaline earth metal silicates are sodium and/or potassium silicates with a modulus of 1.0 to 3.0 and preferably 1.5 to 2.0. The silicates are normally used in quantities of 0.8 to 1.2% by weight, based on the composition.

Phosphonic Acids and Phosphonates

Phosphonic acids in the context of the invention are understood to be organic derivatives of the acid $HP(O)(OH)_2$; phosphonates are the salts and esters of these phosphonic acids. The organic phosphonic acids or phosphonates preferably used for the purposes of the invention are known chemical compounds which may be prepared, for example, by the Michaelis-Arbuzov reaction. They correspond to formula (I):

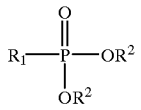

(I)

in which $R^1$ is an optionally functionalized alkyl and/or alkenyl group containing 1 to 22 carbon atoms, preferably 2 to 18 carbon atoms and more preferably 6 to 12 carbon atoms and $R^2$ is hydrogen, an alkali metal and/or alkaline earth metal, ammonium, alkylammonium and/or alkanolammonium or an optionally functionalized alkyl and/or alkenyl radical containing 1 to 22, preferably 2 to 18 and more preferably 6 to 12 carbon atoms. Typical examples are optionally hydroxy-, nitrilo- and/or amino-substituted phosphonic acids such as, for example, ethyl phosphonic acid, nitrilotris(methylene phosphonic acid), 1-amino- or 1-hydroxyalkane-1,1-diphosphonic acids. A preferred embodiment of the invention is characterized by the use of amine oxide phosphonic acids which correspond to formula (II):

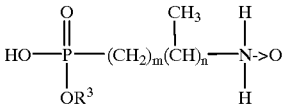

(III)

where $R^3$ is hydrogen, a $(CH_2)_m(CHCH_3)_nNH_2O$ group or an alkali metal, m is a number of 1 to 4 and n is 0 or 1. Amine oxide phosphonic acids are builders or sequestering agents which are marketed, for example, by Bozetto, Italy, under the name of SEQUION®. They are produced by reacting aminophosphonic acids to form the amine oxide. Both mono- and diamine oxides in the form of the phosphonic acids or salts corresponding to formula (II) may be used for the purposes of the invention. Amine oxide phosphonic acids in which $R^3$ is hydrogen, m is 3 and n is 0 (amine oxide based on aminotrimethylene phosphonic acid) are preferably used. The phosphonic acids or phosphonates are normally used in quantities of 0.3 to 0.7% by weight, based on the composition.

Polyacrylic Acid Compounds

Polyacrylic acid compounds in the context of the invention are preferably homopolymers of acrylic acid and methacrylic acid or esters thereof. Besides the acids, esters of the acids with alcohols containing 1 to 4 carbon atoms can also be polymerized. Polyacrylic acid compounds with a particularly advantageous stabilizing effect are present as alkali metal salts and have an average molecular weight in the range from 1,000 to 10,000 and more particularly in the range from 4,000 to 6,000 dalton. They are preferably used in quantities of 0.02 to 0.05% by weight.

Alkyl Ether Sulfates

The compositions according to the invention may contain as further components surfactants of the alkyl ether sulfate type which may be obtained by sulfation of alkyl polyglycol ethers and subsequent neutralization. The alkyl ether sulfates suitable for the purposes of the invention correspond to formula (III):

$$R^4O—(CH_2CH_2O)_nSO_3X \quad \text{(III)}$$

where $R^4$ is an alkyl group containing 12 to 18 and, more particularly, 12 to 14 carbon atoms, n is a number of 2 to 5 and, more particularly, 2 to 3 and X is sodium or potassium. Typical examples are the sodium salts of sulfates of the $C_{12/14}$ cocoalcohol+2, +2.3 and +3 EO adduct. The alkyl ether sulfates may have a conventional or narrow homolog distribution. The alkyl ether sulfates are used in quantities of preferably 1 to 8% by weight, more preferably 1.5 to 6% by weight and most preferably 2 to 4% by weight, based on the composition.

Amine Oxides

Amine oxides are also known substances which are occasionally classed as cationic surfactants, but generally as nonionic surfactants. They are produced from tertiary fatty amines which normally have one long and two short or two long and one short alkyl chain by oxidation in the presence of hydrogen peroxide. The amine oxides suitable as surface-active ingredients for the purposes of the invention correspond to formula (IV):

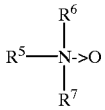

(IV)

in which $R^5$ is a linear or branched alkyl group containing 12 to 18 carbon atoms and $R^6$ and $R^7$ independently of one another have the same meaning as $R^5$ or represent an optionally hydroxy-substituted alkyl group containing 1 to 4 carbon atoms. Amine oxides corresponding to formula (IV), in which $R^5$ and $R^6$ represent $C_{12/14}$ or $C_{12/18}$ cocoalkyl radicals and $R^7$ is a methyl group or a hydroxyethyl group, are preferably used. Amine oxides corresponding to formula (IV), in which $R^5$ is a $C_{12/14}$ or $C_{12/18}$ cocoalkyl group and $R^6$ and $R^7$ represent a methyl or hydroxyethyl group, are also preferred. The amine oxides are preferably used in quantities of 1.5 to 6% by weight and more preferably in quantities of 2 to 4% by weight, based on the composition.

Alkyl and/or Alkenyl Oligoglycosides

Alkyl and alkenyl oligoglycosides are known nonionic surfactants which correspond to formula (V):

$$R^8O—[G]_p \quad (V)$$

where $R^8$ is an alkyl and/or alkenyl radical containing 4 to 22 carbon atoms, G is a sugar unit containing 5 or 6 carbon atoms and p is a number of 1 to 10. The alkyl and/or alkenyl oligoglycosides also suitable as surface-active ingredients may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (V) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^8$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^8$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil fatty alcohol having a DP of 1 to 3 are preferred. The glycosides are used in quantities of preferably 1.5 to 6% by weight and more preferably 2 to 4% by weight, based on the composition.

Fatty Acid Salts

The compositions according to the invention may contain as further surfactants fatty acid salts corresponding to formula (VI):

$$R^9CO—OX \quad (VI)$$

in which $R^9CO$ is an acyl group containing 12 to 22 carbon atoms and X is an alkali metal. Typical examples are the sodium and/or potassium salts of lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and the technical mixtures thereof obtained in the pressure hydrolysis of technical fats and oils. Salts of technical cocofatty acid or tallow fatty acid are preferably used. Since the formulations according to the invention are highly alkalized, the salts may also be replaced by the fatty acids which are neutralized in situ on introduction into the mixture. Those compositions according to the invention which are required to be particularly low-foaming preferably contain fatty acid salts as an optional component. The soaps are preferably used in quantities of 1.5 to 6% by weight and more preferably in quantities of 2 to 4% by weight, based on the composition.

COMMERCIAL APPLICATIONS

The compositions according to the invention generally have a non-aqueous component of 5 to 35 and preferably 8 to 15% by weight and are suitable for the treatment of textile materials such as, for example, yarns, webs and, in particular, textiles. They are normally used at low temperatures, i.e. in cold washing (ca. 15 to 25° C.). The compositions are not only distinguished by excellent stain removal, they also reliably prevent the deposition of lime and metal traces on the fibers and, in doing so, also prevent incrustation and yellowing. Although the actual use of the compositions is directed to the removal of stains during the washing process, the compositions are also basically suitable for other applications where hypochlorite solutions are used, for example the cleaning and disinfection of hard surfaces.

Suitable other auxiliaries and additives are, for example, other chlorine-stable surfactants and hydrotropes such as, for example, alkyl sulfates, alkyl sulfonates, alkyl benzenesulfonates, xylenesulfonates, sarcosinates, taurides, isethionates, sulfosuccinates, betaines, sugar esters, fatty alcohol polyglycol ethers and fatty acid-N-alkyl glucamides. The sum total of all surfactants, based on the compositions, is preferably 1 to 15% by weight and more preferably 5 to 10% by weight. The compositions according to the invention generally have a pH value of 12.5 to 14.

In addition, the compositions may contain active-chlorine-stable fragrances, optical brighteners, dyes and pigments in a total quantity of 0.01 to 0.5% by weight, based on the composition. Known fragrances resistant to active chlorine include, for example, monocyclic and bicyclic monoterpene alcohols and esters thereof with acetic or propionic acid (for example isoborneal, dihydroterpineol, isobornyl acetate, dihydroterpenyl acetate). The optical brightener may be, for example, the potassium salt of 4,4'-bis-(1,2,3-triazolyl)-(2-)-stilbene-2,2-sulfonic acid which is marketed under the name of Phorwite® BHC 766. Suitable pigments are inter alia green chlorophthalocyanines (Pigmosol® Green, Hostaphine® Green) or yellow Solar Yellow BG 300 (Sandoz). The compositions according to the invention are produced by stirring. The product obtained may optionally be decanted or filtered to remove foreign matter and/or agglomerates. In addition, the compositions have a viscosity above 100 mPas, as measured at 20° C. in a Brookfield viscosimeter.

The present invention also relates to the use of mixtures consisting of (a) silicates, (b) phosphonic acids and/or phosphates and (c) polyacrylic acid compounds as incrustation and yellowing inhibitors for the production of aqueous bleaching compositions. The mixtures may contain the components in a ratio by weight of (a) to (b) to (c) of (10 to 50):(5 to 25):(10 to 50), with the proviso that the quantities add up to 100 parts by weight.

EXAMPLES

In order to test the bleaching effect, soiled fabrics were treated with various bleaching solutions. The clouding of the formulations was visually assessed after storage for 1 week and 4 weeks at 20° C. The incrustation of the fabrics were determined by incineration whereas yellowing of the fabrics was determined photometrically, the starting value of the soiled fabrics serving as standard (100%). The measurements were carried out in a liquor with a metal ion content of 300 ppb Fe and 100 ppb Mn; the water hardness was 300 ppm $CaCO_3$. The liquor ratio (fabric:water) was 1:50 and the exposure time 30 minutes at a temperature of 40° C. The results are set out in Table 1 below where the figures represent percentages by weight. Compositions 1 and 2 correspond to the invention while mixtures C1 to C3 are intended for comparison.

TABLE 1

| | Bleaching effect | | | | |
|---|---|---|---|---|---|
| Composition | 1 | 2 | C1 | C2 | C3 |
| Sodium hypochlorite | 5.0 | 5.0 | 5.0 | 5.0 | 5.0 |
| Sodium hydroxide | 0.9 | 0.95 | 1.0 | 0.9 | 0.5 |
| Sodium silicate | 0.95 | 0.95 | 1.0 | — | 0.8 |
| Sodium carbonate | — | — | 0.5 | 1.2 | 1.2 |
| Amine oxide phosphonic acid** | 0.1 | 0.1 | — | 0.1 | — |
| Polyacrylate*** | 0.05 | 0.05 | 0.05 | 0.05 | 0.05 |
| Appearance after 1 week | Clear | Clear | Clear | Clear | Cloudy |
| Appearance after 4 weeks | Clear | Clear | Cloudy | Cloudy | Cloudy |
| Incrustation [%-rel] | 105 | 103 | 113 | 115 | 118 |
| Yellowing [%-rel] | 28 | 32 | 54 | 56 | 54 |

*Modulus 2.0,
**Sequion ®,
***Norasol ® LMW 45 N (sodium salt, MW = 4,500, product of NorsoHaas)

It can be seen that the compositions according to the invention are clouding-free, even after storage, and lead to fewer lime deposits and less yellowing of the treated textiles compared with the prior-art products.

What is claimed is:

1. An aqueous bleaching composition comprising:

1.0 to 10.0% by weight of alkali metal hypochlorite;

0.5 to 1.5% by weight of alkali metal hydroxide;

0.5 to 2% by weight of silicates;

0.01 to 1.0% by weight of phosphonic acids and/or phosphonates; and 0.01 to 1.0% by weight of polyacrylic acid compounds.

2. The composition of claim 1 wherein the alkali metal hypochlorite comprises sodium hypochlorite.

3. The composition of claim 1 comprising 3 to 7% by weight of alkali metal hypochlorite.

4. The composition of claim 3 comprising 4 to 6% by weight of alkali metal hypochlorite.

5. The composition of claim 1 wherein the alkali metal hydroxide comprises sodium hydroxide.

6. The composition of claim 1 comprising 0.7 to 1.2% by weight alkali metal hydroxide.

7. The composition of claim 1 wherein the silicates comprise sodium silicate, potassium silicate, aluminosilicate or mixtures thereof.

8. The composition of claim 1 comprising 0.8 to 1.2% of silicates.

9. The composition of claim 1 wherein the phosphonic acid or phosphonate corresponds to the formula (I):

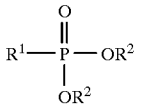

(I)

wherein $R^1$ is an optionally functionalized alkyl and/or alkenyl group containing 1 to 22 carbon atoms, and $R^2$ is hydrogen, an alkali metal, an alkaline earth metal, ammonium, alkylammonium, alkanolammonium, an optionally functionalized alkyl and/or alkenyl radical containing 1 to 22 carbon atoms, or mixtures thereof.

10. The composition of claim 1 comprising 0.3 to 0.7% of phosphonic acids and/or phosphonates.

11. The composition of claim 1 comprising 0.02 to 0.05% polyacrylic acid compounds.

12. The composition of claim 1 wherein the polyacrylic acid compounds have and average molecular weight in the range of from 1,000 to 10,000 daltons.

13. The composition of claim 12 wherein the polyacrylic acid compounds have and average molecular weight in the range of from 4,000 to 6,000 daltons.

14. The composition of claim 1 comprising amine oxide phosphonic acids corresponding to formula (II):

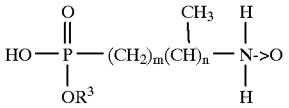

wherein $R^3$ is hydrogen, a $(CH_2)_m(CHCH_3)_nNH_2O$ group or an alkali metal, m is a number of from 1 to 4, and n is 0 to 1.

15. The composition of claim 14 comprising 1 to 8% by weight of alkyl ether sulfates.

16. The composition of claim 1 further comprising 2 to 4% by weight of alkyl ether sulfates.

17. The composition of claim 14 comprising 1.5 to 6% by weight of amine oxides.

18. The composition of claim 1 further comprising 1.5 to 6% by weight of alkyl and/or alkenyl oligoglycosides.

19. The composition of claim 1 further comprising a fatty acid salt.

20. The composition of claim 1 further comprising 1 to 15% by weight of surfactants and fatty acid salts.

* * * * *